US006863457B2

(12) United States Patent
Hayashi

(10) Patent No.: US 6,863,457 B2
(45) Date of Patent: Mar. 8, 2005

(54) LATERAL EDGE POSITION DETECTOR FOR RECORDING PAPER, AND PRINTER

(75) Inventor: Junji Hayashi, Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/693,919

(22) Filed: Oct. 28, 2003

(65) Prior Publication Data

US 2004/0085434 A1 May 6, 2004

(30) Foreign Application Priority Data

Oct. 28, 2002 (JP) ..... 2002-312051
Sep. 22, 2003 (JP) ..... 2003-330591

(51) Int. Cl.[7] ..... B41J 21/46; B41J 19/18
(52) U.S. Cl. ..... 400/279; 400/120.01; 400/61
(58) Field of Search ..... 400/279, 120.01, 400/64, 61, 342, 706, 708, 709

(56) References Cited

U.S. PATENT DOCUMENTS 5,255,987 A * 10/1993 Mizuno et al. ..... 400/61
5,651,039 A * 7/1997 Hidding et al. ..... 377/24
6,039,481 A * 3/2000 Ham ..... 400/708
6,152,626 A * 11/2000 Yanagi et al. ..... 400/279
6,305,856 B1 10/2001 Miyazaki ..... 400/279

* cited by examiner

*Primary Examiner*—Andrew H. Hirshfeld
*Assistant Examiner*—Wasseem H. Hamdan
(74) *Attorney, Agent, or Firm*—Sughrue Mion, PLLC

(57) ABSTRACT

A thermal printer includes a thermal head which extends in a main scan direction. Feeder rollers move thermal recording paper relative to the thermal head in a sub scan direction, for image recording to the recording paper in a surface recording manner. In the thermal printer, at least one position detector includes a contact lever, rotatable about a rotational center. There is an edge contact surface for being pressed by a lateral edge of the recording paper. An encoding panel projects from the contact lever and away from the recording paper, and is shiftable in response to rotation of the contact lever. A detection pattern is formed on the encoding panel, and extends in a shifting direction thereof. An encoding sensor of two-phase outputting encoding is disposed in a shifting path of the detection pattern, for photoelectrically detecting a shifted position of the detection pattern.

16 Claims, 12 Drawing Sheets

LATERAL EDGE POSITION DETECTOR FOR RECORDING PAPER, AND PRINTER

BACKGROUND OF THE INVENTION

1. Field of the Invention

The present invention relates to a lateral edge position detector for recording paper, and a printer. More particularly, the present invention relates to a lateral edge position detector for recording paper, and a printer, in which detection of a lateral edge of the recording paper is possible with a simple structure, and precisely and stably.

2. Description Related to the Prior Art

A digital still camera has been widely used. A user electronically photographs an image with the digital still camera, to store image data. To reproduce the image, a color printer is used, in which the image data is processed to produce a full-color print on a recording medium, such as recording paper. It has been conceivable to produce a full-width print having no blank margins on any edge of the periphery of the image. This is effective in utilizing a printing surface of the recording paper without waste.

A color thermal printer is included in the various image forming apparatuses, and capable of producing a full-color print. For the color thermal printer, color thermosensitive recording medium is used, and includes a support, and yellow, magenta and cyan thermosensitive coloring layers overlaid thereon. A thermal head or printhead includes an array of heating elements, which apply pressure and heat to the recording paper. The coloring layers are heated and colored one after another, to record a full-color image on the recording paper according to three-color frame-sequential recording.

To produce a full-width print in the color thermal printer, it is necessary to enlarge the width of the array of the heating elements over the width of the recording paper. If some of the heating elements not contacting the recording paper are driven, wasteful heat is generated. This is unfavorable because the life of the heating elements will be shortened. In view of this, there is a proposed printer which includes a CCD line sensor, and in which a lateral edge of the recording paper is detected by the CCD line sensor to determine the position of the recording paper in the main scan direction or array direction of the heating elements. The non-contact heating elements are recognized, and are kept from energisation. For example, U.S. Pat. No. 6,305,856 (corresponding to JP-A 2001-030532) discloses a printer including the CCD line sensor of which a length is greater than the width of the recording paper. Also, it is conceivable to use a small type of two CCD line sensors disposed near to lateral edges of the recording paper.

The CCD line sensor having a long shape is remarkably expensive, and is a specific cause to raise a manufacturing cost of the color thermal printer. The total number of produced articles of the CCD line sensor with the great length is somewhat low. It is considerably difficult to plan the production of the color thermal printer because of the difficulty in expecting the demand of the CCD line sensor.

The CCD line sensor with a small size, in contrast, is inexpensive, and easy to obtain. However, a portion along the lateral edge of the recording paper is likely to have a curl, so as to change a distance from the lateral edge to the CCD line sensor. The change in the distance to the recording paper causes changes in the signal level of an output of the CCD line sensor. Thus, the precision in the position detection of the recording paper will be lower. Note that it is possible to change the type of the recording paper from an ordinary type to a sticker type. If the sticker type of the recording paper is used for a long time, an adhesive component is likely to bleed out of the sticker, and deposit on the surface of the CCD line sensor. This lowers the cleanness of the detecting surface of the CCD line sensor, to lower the precision in the detection.

SUMMARY OF THE INVENTION

In view of the foregoing problems, an object of the present invention is to provide a lateral edge position detector for a recording medium, and a printer, easily capable of detection of a lateral edge of the recording medium even with a simple structure.

Another object of the present invention is to provide a lateral edge position detector for a recording medium, and a printer, capable of detection of a lateral edge of the recording medium with high precision and high stability.

In order to achieve the above and other objects and advantages of this invention, an image forming apparatus includes an image forming unit disposed opposite to a recording medium and to extend in a main scan direction. A feeder mechanism moves a first one of the image forming unit and the recording medium relative to a second one thereof in a sub scan direction, for image recording to the recording medium in a surface recording manner. In the image forming apparatus, there is at least one position detector, which includes a lateral edge contact mechanism, rotatable about a rotational center, provided with an edge contact surface for being pressed by a lateral edge of the recording medium. An encoding panel is disposed to project from the lateral edge contact mechanism and away from the recording medium, and shiftable in response to rotation of the lateral edge contact mechanism. A detection pattern is formed on the encoding panel, and disposed to extend in a shifting direction thereof. An encoding sensor of two-phase outputting encoding is disposed in a shifting path of shifting of the detection pattern, for photoelectrically detecting a shifted position of the detection pattern.

The encoding panel is disposed opposite to the edge contact surface with respect to the rotational center, and when the lateral edge presses the edge contact surface in a first direction, the detection pattern is shifted by transmission of the lateral edge contact mechanism in a second direction different from the first direction.

The at least one position detector further comprises a bias mechanism for biasing the lateral edge contact mechanism in a direction to press the edge contact surface against the lateral edge of the recording medium.

The detection pattern includes plural slits arranged in the shifting direction.

The lateral edge contact mechanism includes a rotatable contact lever, connected with the encoding panel, for shifting thereof. An edge receiving portion has the edge contact surface, for shifting upon being pressed by the lateral edge in the main scan direction, to rotate the contact lever.

The at least one position detector further comprises a counter, responsive to a signal from the encoding sensor, for counting slits among the slits moved past the encoding sensor.

The encoding panel is movable from an initial position toward a shifted position, and when the contact lever stands free without the recording medium on the edge contact surface, the encoding panel is in the initial position, and a closed portion of the encoding panel disposed beside the detection pattern is opposed to the encoding sensor.

The edge contact surface is inclined, and when the recording medium is supplied initially, is pressed by a front corner of the lateral edge for contact therewith.

The at least one position detector further comprises a pair of block ridges, formed to project from upper and lower portions of the edge contact surface, for blocking vertical shifting of the recording medium.

The lateral edge of the recording medium comprises first and second lateral edges for extending in the sub scan direction. The at least one position detector comprises first and second position detectors adapted for position detection of the first and second lateral edges in relation to the main scan direction.

The image forming unit includes a thermal head, and the recording medium is thermosensitive.

In one preferred embodiment, the encoding panel is rotatable together with the lateral edge contact mechanism about the rotational center, and the shifting direction thereof is arc-shaped.

The edge receiving portion is an edge receiving projection for projecting from the contact lever.

The encoding panel is rotatable in a region included in a spatial locus defined by parallel movement of the recording medium vertically to a printing surface thereof.

Furthermore, a reinforcing plate is overlaid on the edge contact surface for reinforcement.

In another preferred embodiment, the contact lever has first and second ends, the first end is engaged with the edge receiving portion, and the second end is engaged with the encoding panel.

The encoding panel is slidable in the shifting direction thereof.

Furthermore, a first guide mechanism keeps the edge receiving portion slidable in the main scan direction. A first cam mechanism connects the first end with the edge receiving portion, and for pivotally moving the first end in response to sliding of the edge receiving portion.

Furthermore, a second guide mechanism keeps the encoding panel slidable in the shifting direction. A second cam mechanism connects the second end with the encoding panel, and for sliding the encoding panel in response to pivotal movement of the second end.

The first cam mechanism includes a cam slot, formed in the edge receiving portion, and having a cam surface. A cam follower pin is disposed to project from the first end, inserted in the cam slot, for shifting the cam slot by pressing the cam surface.

The second cam mechanism includes a cam pin for projecting from the second end. A cam follower slot is formed in the encoding panel, for receiving insertion of the cam pin, to shift upon pressing of a cam surface thereof in contact with the cam pin.

Furthermore, a controller checks whether the shifting direction of the encoding panel is back or forth by evaluating a change in an output of the encoding sensor.

The slits are arranged regularly at an angular interval which is equal to a rotational angle defined by each of the slits.

Furthermore, a support panel is disposed higher than the lateral edge in a position of a feeding path of feeding of the recording medium on the feeder mechanism. A central pin projects from the support panel, to constitute the rotational center, so as to support the contact lever in a rotatable manner.

Furthermore, a support bracket is disposed higher than the feeding path in a stationary manner, for supporting the encoding sensor.

Furthermore, an insertion hole is formed in the contact lever, for receiving insertion of the central pin in a rotatable manner.

Furthermore, a stopper pin is formed to project from the contact lever. A stopper portion is formed with the support panel, for engagement with the stopper pin when the lateral edge contact mechanism is in the initial position, to prevent the lateral edge contact mechanism from rotating beyond the initial position.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENT(S) OF THE PRESENT INVENTION

Figure 1:
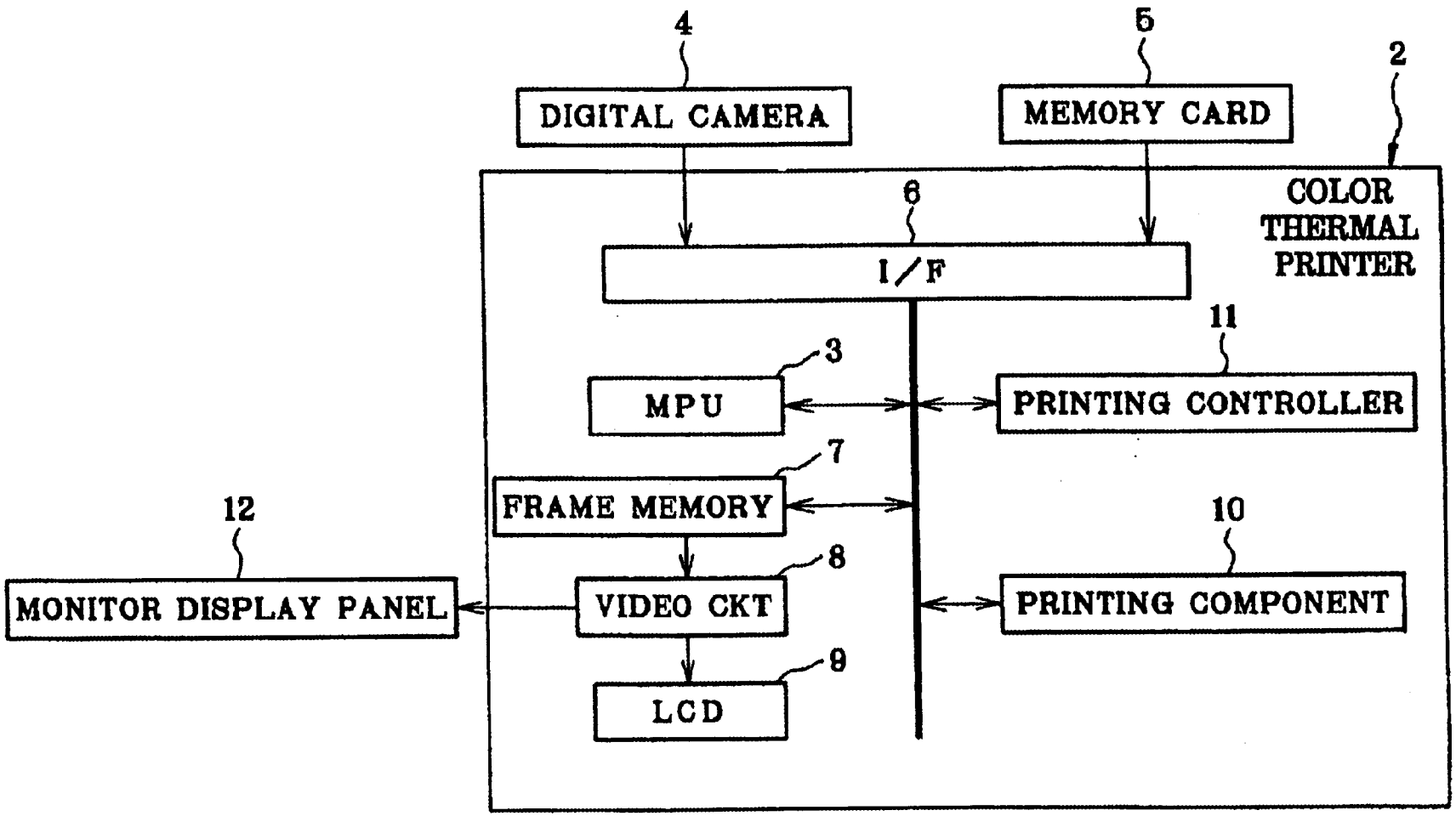
FIG. 1 is a block diagram schematically illustrating a color thermal printer.

In FIG. 1, a color thermal printer 2 as image forming apparatus is schematically illustrated. The color thermal printer 2 is constituted by a microprocessor unit (MPU) 3, an interface (I/F) 6, a frame memory 7, a video circuit 8, a liquid crystal display (LCD) panel 9, a printing component 10, and a printing controller 11. The MPU 3 entirely controls relevant elements included in the color thermal printer 2. The interface 6 is used for connection with external instruments, such as a digital camera 4, for example a digital still camera and a digital video camera, and an external storage, such as a memory card 5, an optical disk and a hard disk, and a personal computer. The frame memory 7 stores image data input through the interface 6. The video circuit 8 converts the image data to a video signal of the NTSC format or the like. The LCD panel 9 displays an image according to the output of the video circuit 8. The printing component 10 is actuated to print an image to recording medium. The printing controller 11 controls the printing component 10. There is a monitor display panel 12, connected with the video circuit 8, for displaying a simulated form of the image.

Figure 2:
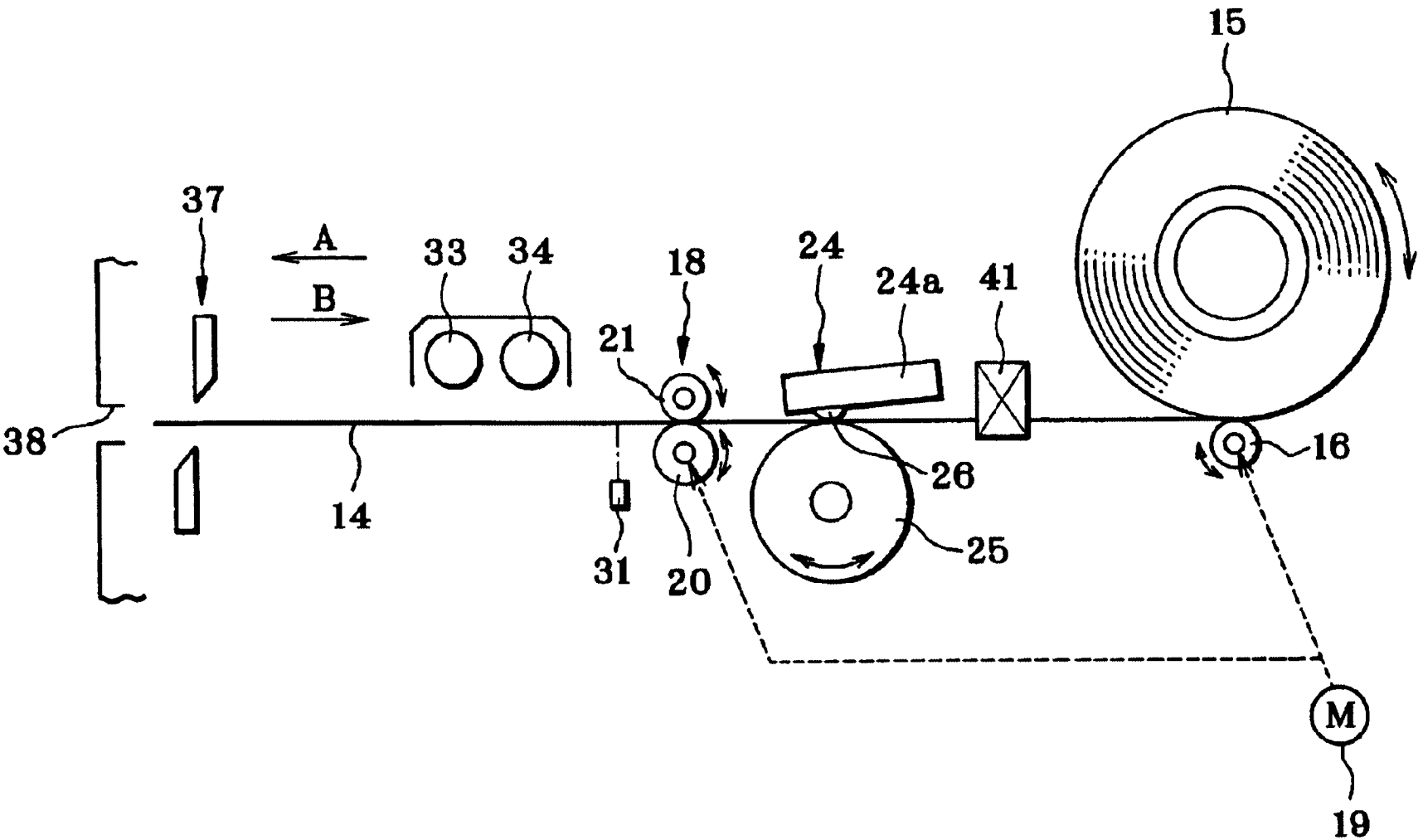
FIG. 2 is an explanatory view in elevation illustrating a printing component.
Figure 3:
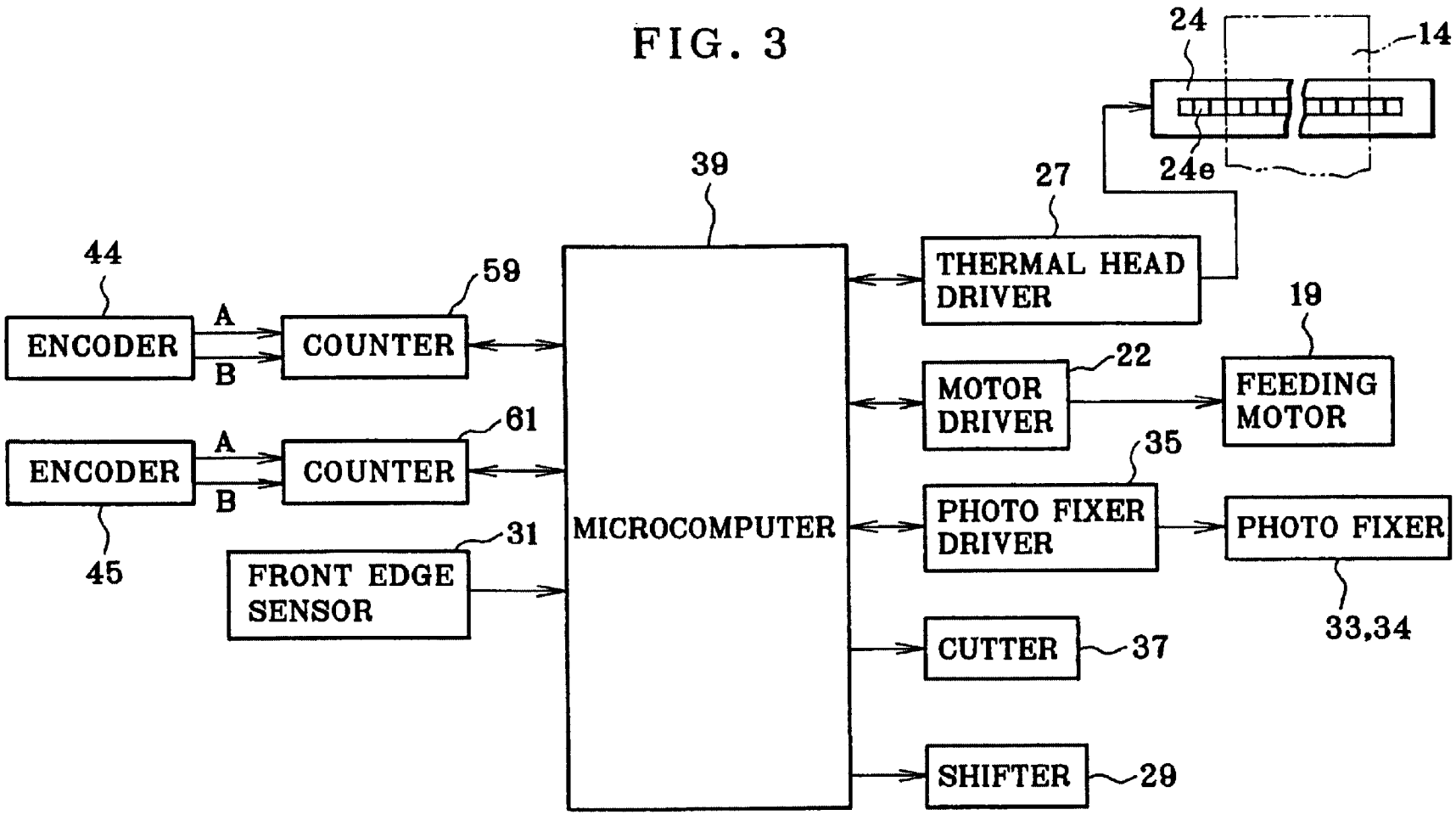
FIG. 3 is a block diagram schematically illustrating the printing component.

In FIG. 2, the image forming unit is illustrated. In FIG. 3, circuit elements for image forming are schematically illustrated. Color thermosensitive recording paper 14 as recording medium with a great length is used in the color thermal printer 2. A recording paper roll 15 is prepared in a rolled form of the recording paper 14, and set in the color thermal printer 2. A supply roller 16 is incorporated in the color thermal printer 2, contacts an outermost turn of the recording paper roll 15, and unwinds and winds back the recording paper 14.

A feeder roller set 18 is disposed downstream from the recording paper roll 15 for feeding the recording paper 14. The feeder roller set 18 is constituted by a capstan roller 20 and a pinch roller 21. A stepping motor or feeding motor 19 is used to drive the capstan roller 20 for rotation. The pinch roller 21 is shifted for pressurization with the capstan roller 20. The feeder roller set 18 nips the recording paper 14 and rotates, to move the recording paper 14 in a forward direction A or a backward direction B in the path defined as the sub scan direction of a thermal head. A motor driver 22 is connected to drive the motor 19.

A thermal head 24 as printhead or image forming unit and a platen roller 25 are positioned upstream from the feeder roller set 18 with reference to the direction A so that a path for feeding the recording paper 14 is disposed between those. The thermal head 24 is constituted by a thermal head board 24*a* and a heating element array 26. The thermal head board 24*a* includes a plate of metal having high conductivity of heat. The heating element array 26 is disposed on the thermal head board 24*a,* and includes a great number of heating elements 24*e* arranged in a main scan direction perpendicular to feeding of the recording paper 14. For the purpose of printing to the full width of the recording paper 14, the heating element array 26 has a length greater than the width of the recording paper 14. A thermal head driver 27 is connected, and drives the thermal head 24.

Note that supply of heat energy is allowed to the central group of heating elements 24*e* opposed to the recording paper 14. To those among the heating elements 24*e* offset from the recording paper 14, supply of heat energy is inhibited, or only heat energy short of a level of bias heat energy enough to coloring at a minimum density is applied.

The platen roller 25 is disposed under the feeding path, and opposed to the heating element array 26. A bias spring (not shown) biases the platen roller 25 upwards toward the thermal head 24. At the time of feeding the recording paper 14, a shifter 29 shifts down the platen roller 25. An example of the shifter 29 is a mechanism including elements such as a cam, solenoid, or the like.

The thermal head 24 pressurizes the recording paper 14 moved in the direction A by the feeder roller set 18, and applies heat to the recording paper 14 with heating elements 24*e* in the heating element array 26 to color the coloring layers. The platen roller 25 is caused to rotate by the movement of the recording paper 14, and receives the back of the recording paper 14 while the recording paper 14 moves past the heating element array 26.

A front edge sensor 31 is disposed downstream from the feeder roller set 18 as viewed in the direction A, and detects a front edge of the recording paper 14 in the course of the initial advance. An example of the front edge sensor 31 is a reflection type of photo sensor. The reflection type includes a light projector element for projecting inspection light to a front edge of the recording paper 14, and a photoreceptor element for receiving the inspection light reflected by the recording paper 14.

A photo fixer is positioned downstream from the thermal head 24 in the direction A, and includes a yellow fixing lamp 33 and a magenta fixing lamp 34. The yellow fixing lamp 33 emits visible violet rays of which a wavelength of an emission peak is 420 nm, and fixes the yellow coloring layer in the recording paper 14. The magenta fixing lamp 34 emits near ultraviolet rays of which a wavelength of an emission peak is 365 nm, and fixes the magenta coloring layer in the recording paper 14. There is a photo fixer driver 35 which drives the fixing lamps 33 and 34.

A cutter 37 is disposed downstream from the yellow fixing lamp 33 as viewed in the direction A, for cutting the recording paper 14 into sheets per recording region. An ejection slot 38 is positioned downstream from the cutter 37 for ejection of the printed sheets created from the recording paper 14.

A microcomputer 39 is incorporated in the printing component 10, and controls the drivers for the relevant circuits, sensors, and other elements. The microcomputer 39 is connected to the MPU 3 by a data bus in the color thermal printer 2.

Figure 4:
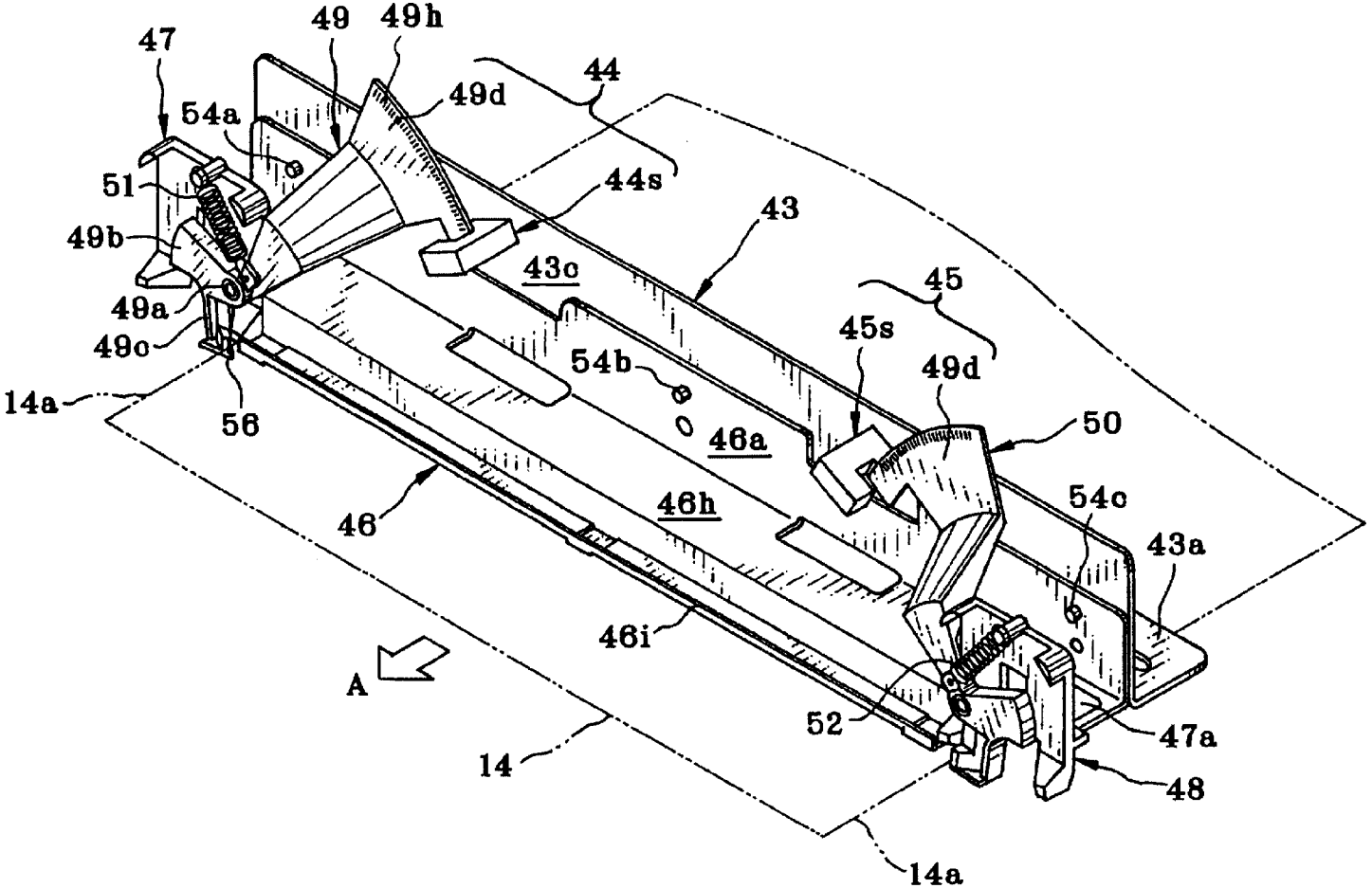
FIG. 4 is a perspective illustrating a set of position detectors.
Figure 5:
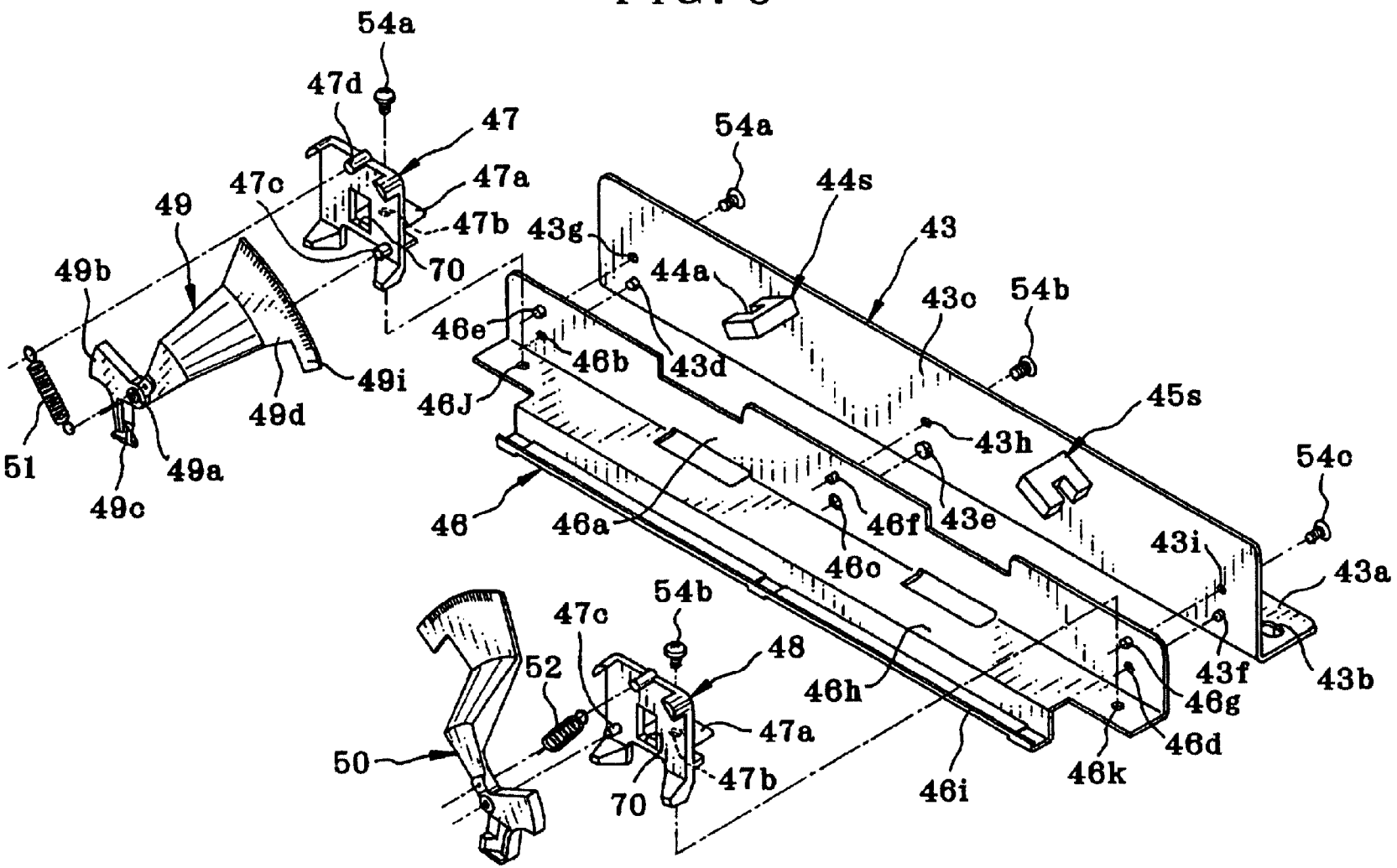
FIG. 5 is an exploded perspective illustrating the position detectors.

There are a pair of position detectors 41 disposed between the thermal head 24 and the supply roller 16, for detecting a position of a lateral edge 14*a* of the recording paper 14 as viewed in the main scan direction that is widthwise in relation to the recording paper 14. In FIG. 4, an overall appearance of the position detectors 41 is illustrated. In FIG. 5, elements in the position detectors 41 are illustrated in combination. The set of the position detectors 41 includes a support bracket 43, encoders 44 and 45, a guide bracket 46, support panels 47 and 48, contact levers 49 and 50, and tension coil springs 51 and 52 as bias mechanisms. The support bracket 43 extends across the feeding path of the recording paper 14 above the recording paper 14. Encoding sensors 44*s* and 45*s* and the guide bracket 46 are attached to the front surface of the support bracket 43. The support panels 47 and 48 are disposed on ends of the guide bracket 46. The contact levers 49 and 50 as lateral edge contact mechanism are supported on respectively the support panels 47 and 48 in a rotatable manner. The tension coil springs 51 and 52 are retained on the support panels 47 and 48.

The support bracket 43 is formed generally in an L-shape as viewed in section by bending a plate of metal. A horizontal panel 43*a* of the support bracket 43 is provided with insertion holes 43*b,* which receive insertion of screws for the purpose of attaching the support bracket 43 to an upper portion disposed over the feeding path. A vertical panel 43*c* is included in the support bracket 43. There are positioning pins 43*d,* 43*e* and 43*f* and holes 43*g,* 43*h* and 43*i* formed on the vertical panel 43*c* and in end positions and a middle position of the same.

The encoder 44 is a two-phase output type, and has generally a channel shape. There is a gap 44*a* defined inside the encoding sensor 44*s*. A first inner face of the gap 44*a* is provided with a light source for emitting parallel beams of light. A second inner face of the gap 44*a* is provided with photoreceptor elements for receiving the light emitted by the light source. The photoreceptor elements output detection signals of the A-phase and B-phase individually. A waveform shaping circuit is incorporated in the encoder 44 for subjecting the analog signals from the photoreceptor elements to waveform shaping, and converting those to digital signals. The encoder 45 is structurally the same as the encoder 44, and is not further described.

The guide bracket 46 is formed generally in an L-shape as viewed in section by bending a plate of metal. A vertical panel 46*a* of the guide bracket 46 is attached to the vertical panel 43*c* of the support bracket 43. Positioning holes 46*b*, 46*c* and 46*d* are formed in the vertical panel 46*a* of the guide bracket 46, and receive insertion of the positioning pins 43*d*–43*f* of the support bracket 43. Screw holes 46*e*, 46*f* and 46*g* are formed in the vertical panel 46*a*. Screws 54*a*, 54*b* and 54*c* inserted through the holes 43*g*–43*i* are helically received in the screw holes 46*e*–46*g*. Also, there are two cutouts or recesses formed in the guide bracket 46 for avoiding interference with the encoders 44 and 45 on the support bracket 43.

A horizontal panel 46*h* of the guide bracket 46 has a front edge. A long guide ridge 46*i* is formed on the front edge for guiding the upward directed printing surface of the recording paper 14. The guide ridge 46*i* is bent nearly in a channel shape or L-shape. A surface of the guide ridge 46*i* for contacting the recording paper 14 is finished with smoothness not to influence the quality of the recording paper 14. Screw holes 46*j* and 46*k* are formed in end portions of the horizontal panel 46*h* of the guide bracket 46, for receiving attachment of the support panels 47 and 48.

The support panel 47 has a quadrilateral shape, and formed from a plastic material. An attachment ridge 47*a* is included in the back of the support panel 47, and attached to the horizontal panel 46*h* of the guide bracket 46. An insertion hole 47*b* at the broken line in FIG. 5 is formed in the attachment ridge 47*a* for receiving insertion of the screw 54*a*. A front of the support panel 47 is provided with a bearing pin or rotational central pin 47*c* and a spring end pin 47*d*. The central pin 47*c* keeps the contact lever 49 rotatable. The spring end pin 47*d* is adapted to retention of one end portion of the tension coil spring 51. Note that the support panel 48 has a form simply by symmetrically inverting the support panel 47, and is not further described.

Figure 6:
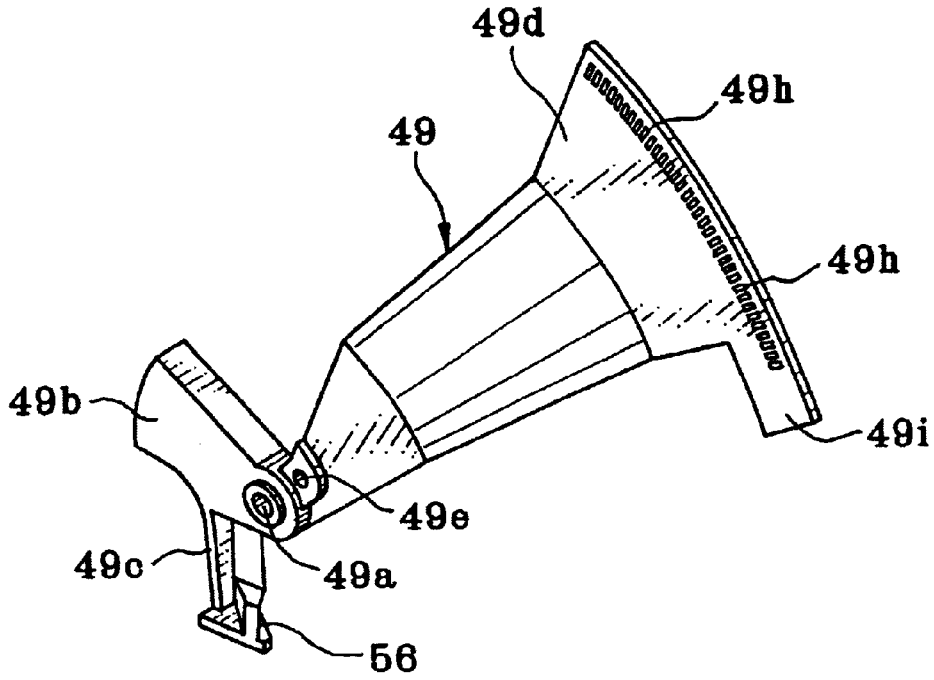
FIG. 6 is a front perspective illustrating a contact lever.
Figure 7:
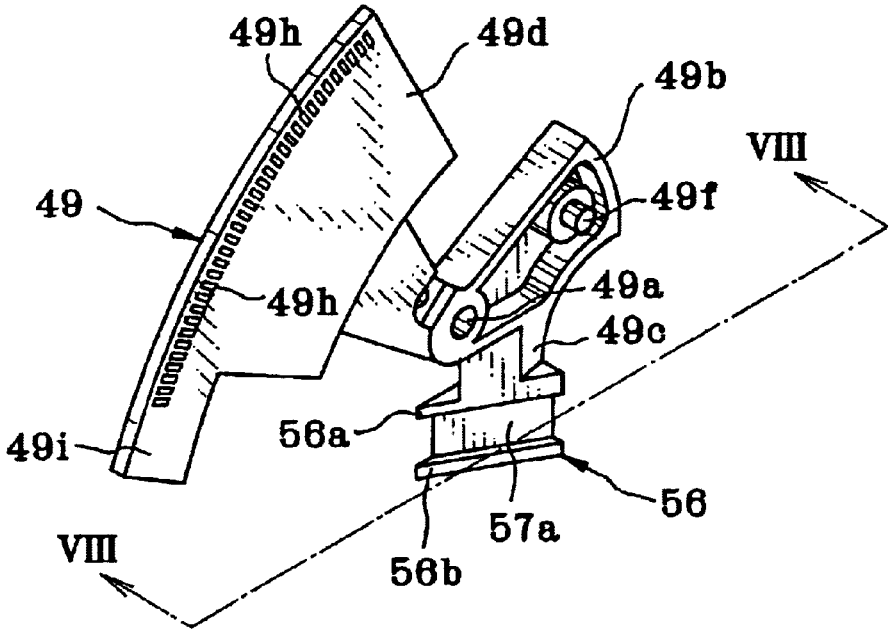
FIG. 7 is a rear perspective illustrating the contact lever.

In FIG. 6 for illustrating in enlargement, the contact lever 49 includes a receiving lever portion 49*b*, an edge receiving projection 49*c*, and a rotatable sector-shaped encoding panel 49*d*. The receiving lever portion 49*b* has an insertion hole 49*a* for receiving insertion of the central pin 47*c* of the support panel 47. The edge receiving projection 49*c* projects down from a lower side of the receiving lever portion 49*b*. The rotatable encoding panel 49*d* projects from an upper portion of the receiving lever portion 49*b* with an inclination. A spring end hole 49*e* is formed in a base portion of the rotatable encoding panel 49*d*, for retention of a second end of the tension coil spring 51. In FIG. 7 illustrating the rear of the contact lever 49, a stopper pin 49*f* projects from the rear of the receiving lever portion 49*b* for engagement with a stopper edge inside a stopper opening 70 as stopper portion, so as to regulate a range of rotation of the contact lever 49.

The rotatable encoding panel 49*d* is positioned higher than the recording paper 14, and is kept rotatable inside a region or space defined by a locus obtained by vertically moving a recording region of the recording paper 14. This construction of the rotatable encoding panel 49*d* is effective in preventing enlargement of the size of the color thermal printer 2 in the main scan direction.

Figure 8:
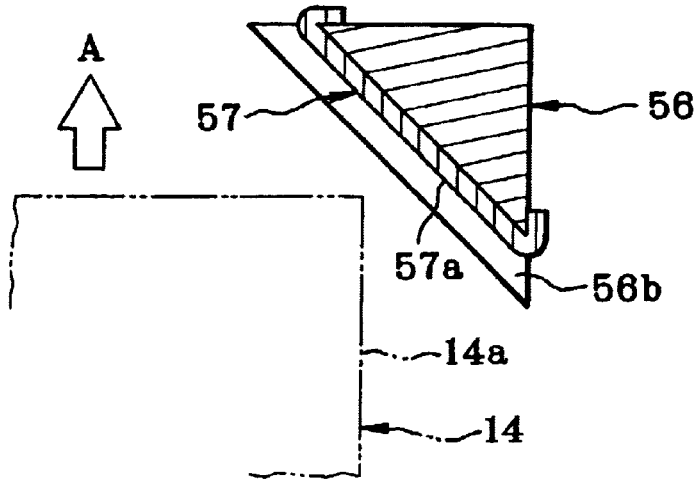
FIG. 8 is a cross section taken on line VIII—VIII in FIG. 7.

An edge receiving projection 56 projects from the edge receiving projection 49*c* of the contact lever 49 for receiving contact of the lateral edge 14*a* of the recording paper 14. FIG. 8 is a section taken on line VIII—VIII in FIG. 7. An edge contact surface 57*a* is provided on the edge receiving projection 56, and has an inclination of 45 degrees with reference to the direction A of feeding of the recording paper 14. This is effective in preventing accidental bending of an edge or corners of the recording paper 14 even when the edge comes in contact with the edge contact surface 57*a*. Note that a reinforcing plate 57 is fixedly secured to the edge receiving projection 56 for defining the edge contact surface 57*a*. The reinforcing plate 57 is a piece of metal having high smoothness and high resistance to abrasion. There are block ridges 56*a* and 56*b* projecting from upper and lower portions of the edge receiving projection 56 and having a projecting size more than the edge contact surface 57*a*. The block ridges 56*a* and 56*b* regulate the lateral edge 14*a* of the recording paper 14 in the vertical direction, to raise the precision of detection of the recording paper 14.

The rotatable encoding panel 49*d* is formed generally in a sector shape. A detection pattern 49*h* of slits is formed in the rotatable encoding panel 49*d*. The slits are arranged at a constant pitch of a rotational angle for the purpose of detection. The rotatable encoding panel 49*d* includes a first portion in connection with the receiving lever portion 49*b* of the contact lever 49, and a second portion having the detection pattern 49*h*. The second portion is offset backwards relative to the first portion. This is for the purpose of inserting the second portion of the rotatable encoding panel 49*d* into the gap 44*a* of the encoder 44 secured on the support bracket 43.

Figure 9:
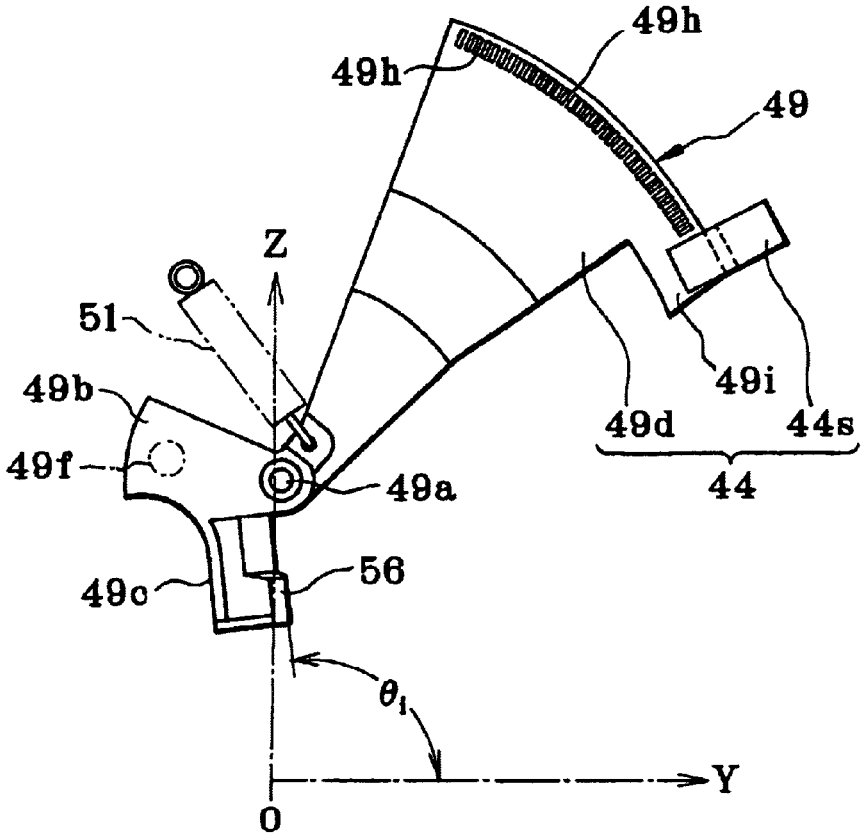
FIG. 9 is a front elevation illustrating a state of the contact lever set in an initial position.
Figure 10:
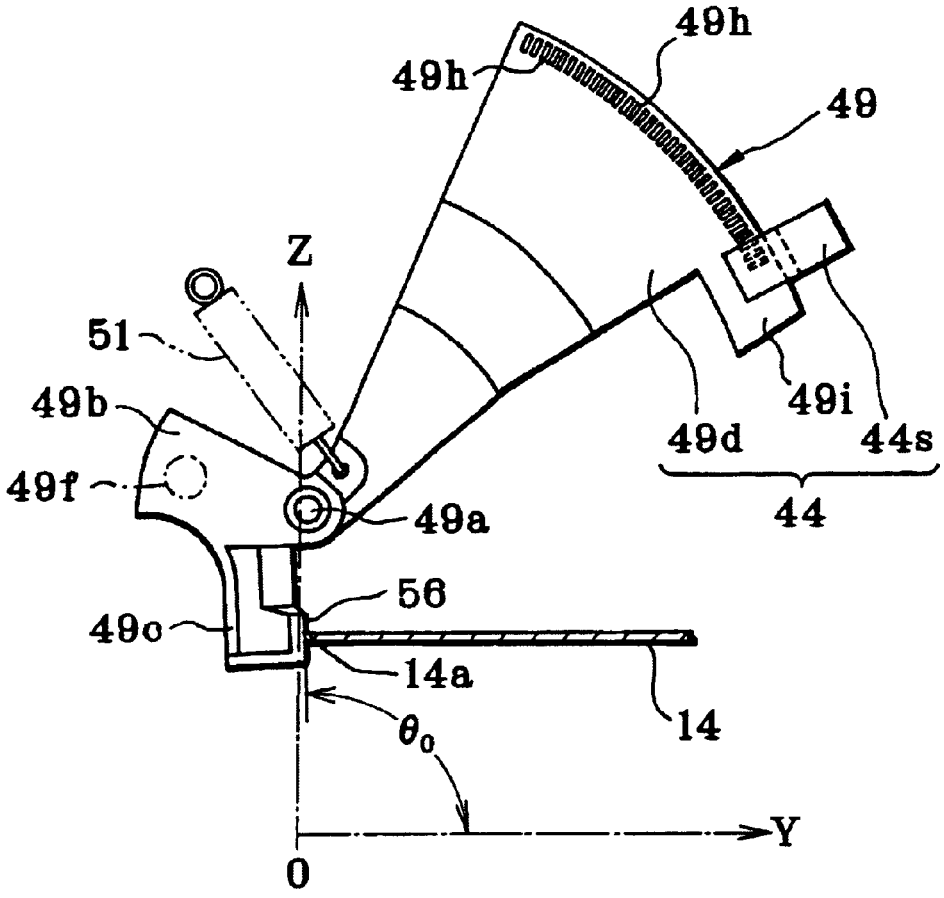
FIG. 10 is a front elevation illustrating a state of the contact lever set in a reference position.

In FIGS. 9, 10 and 11, a relationship between the recording paper 14, the contact lever 49 and the encoder 44 is illustrated. An X-axis is taken to extend in the main scan direction. A Y-axis is taken to extend in the sub scan direction. A Z-axis is taken perpendicular to a X-Y plane. The coordinate of Y=0 represents an exactly positioned state of the lateral edge 14*a* of the recording paper 14 having a precisely determined width and fed without offsetting or obliqueness with reference to the Y-axis.

In FIG. 9, a non-printing state of the contact lever 49 is illustrated. In the initial state, the lateral edge 14*a* of the recording paper 14 does not contact the edge receiving projection 56. The contact lever 49 is biased by the tension coil spring 51 and kept in the initial position where the stopper pin 49*f* contacts the support panel 47. Also in the initial state, an initial angle θi is defined between the Y-axis and the edge of the edge receiving projection 56. When the contact lever 49 is in the initial position, one closed portion 49*i* beside the detection pattern 49*h* in the rotatable encoding panel 49*d* is opposed to the encoding sensor 44*s*, to keep an output of the encoder 44 stable.

In FIG. 10, the contact lever 49 stands in its reference position which is rotationally shifted in the clockwise direction from the initial position. When the contact lever 49 rotates to the reference position, the encoder 44 detects one slit in the detection pattern 49*h*. So the counted number of the encoder 44 changes from 0 to 1. At this time, an angle of the contact lever 49 is the reference angle θ0.

Figure 11A:
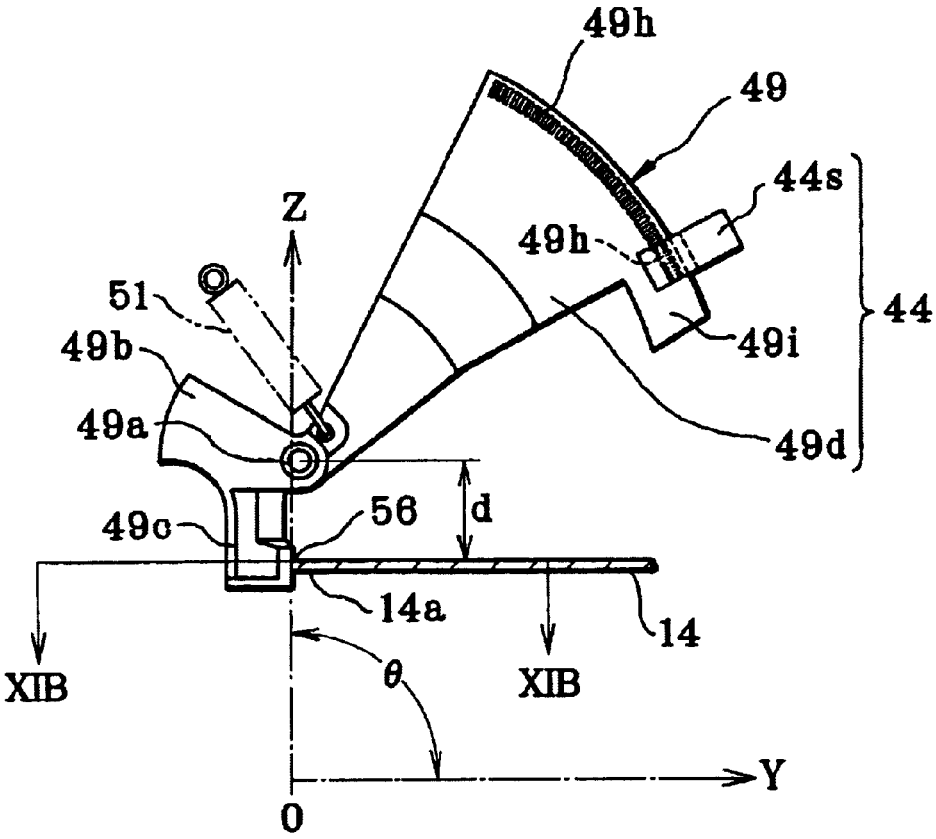
FIG. 11A is a front elevation illustrating detection of the contact lever in an acceptable state.
Figure 11B:
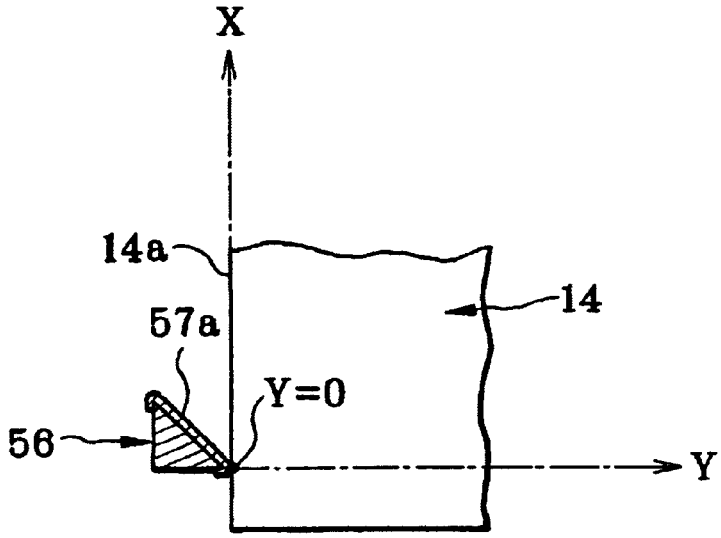
FIG. 11B is an explanatory view in section taken on line XIB—XIB in FIG. 11A.

FIG. 11B is a section taken on line XIB—XIB in FIG. 11A. When the recording paper 14 is fed without an inclination or offset positioning in the direction along the Y-axis, the lateral edge portion of the recording paper 14 pushes the edge receiving projection 56 to rotate the contact lever 49 from the initial position in the clockwise direction past the reference position. An angle θ defined between the Y-axis and the edge of the edge receiving projection 56 is a right angle at this time.

Figure 12A:
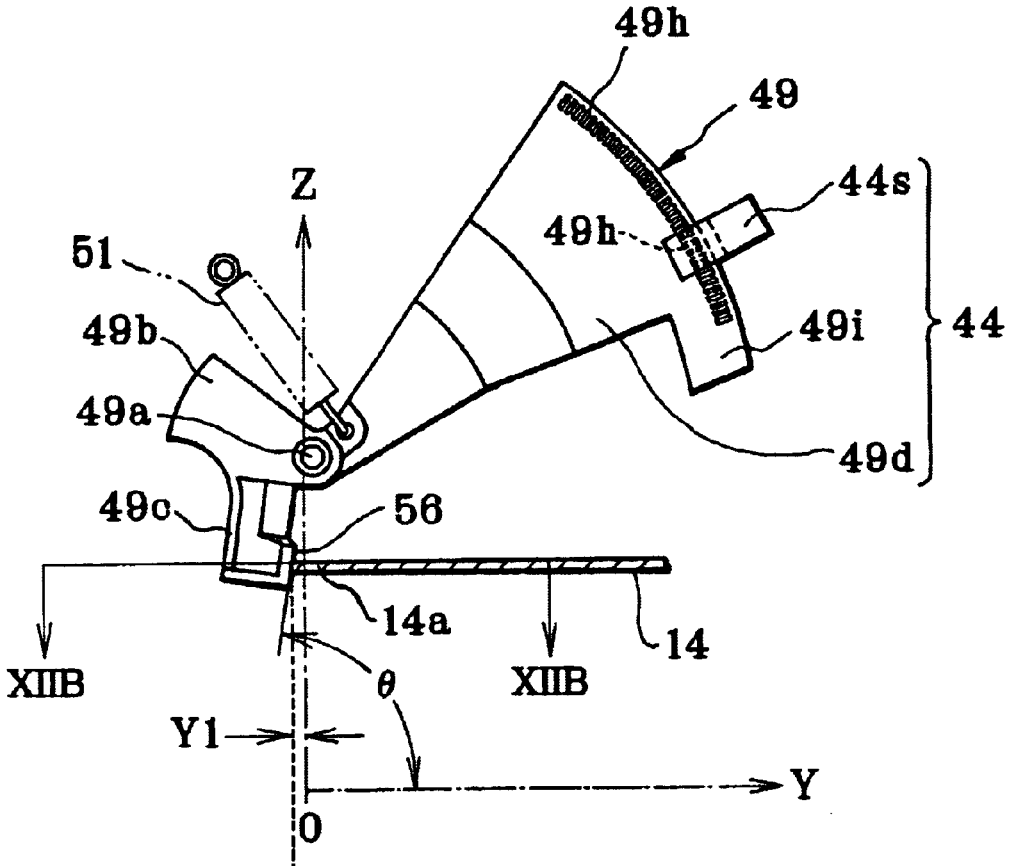
FIG. 12A is a front elevation illustrating a detection of an offset amount of the recording medium.
Figure 12B:
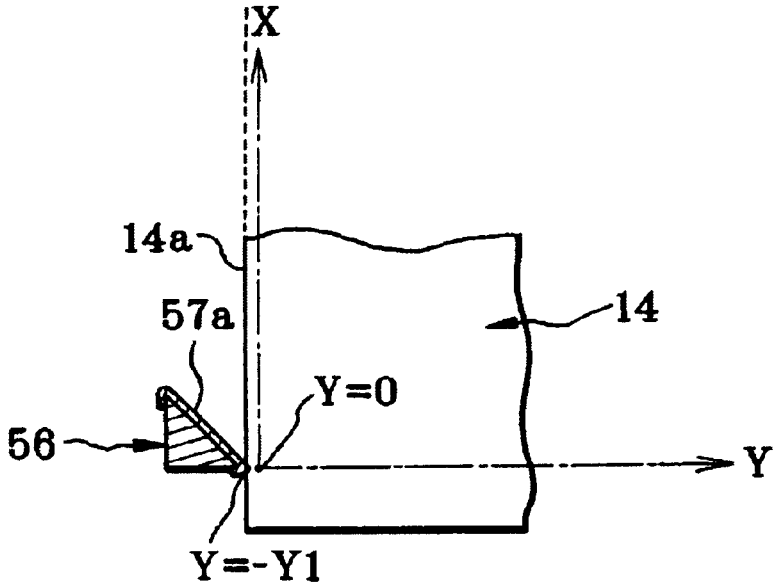
FIG. 12B is an explanatory view in section taken on line XIIB—XIIB in FIG. 11B.

FIG. 12B is a section taken on line XIIB—XIIB in FIG. 12A. As depicted in those drawings, an amount of rotation of the contact lever 49 is greater according to an offset state of the recording paper 14 in the direction of −Y. The angle θ defined between the Y-axis and the edge of the edge receiving projection 56 is an acute angle at this time.

Figure 13:
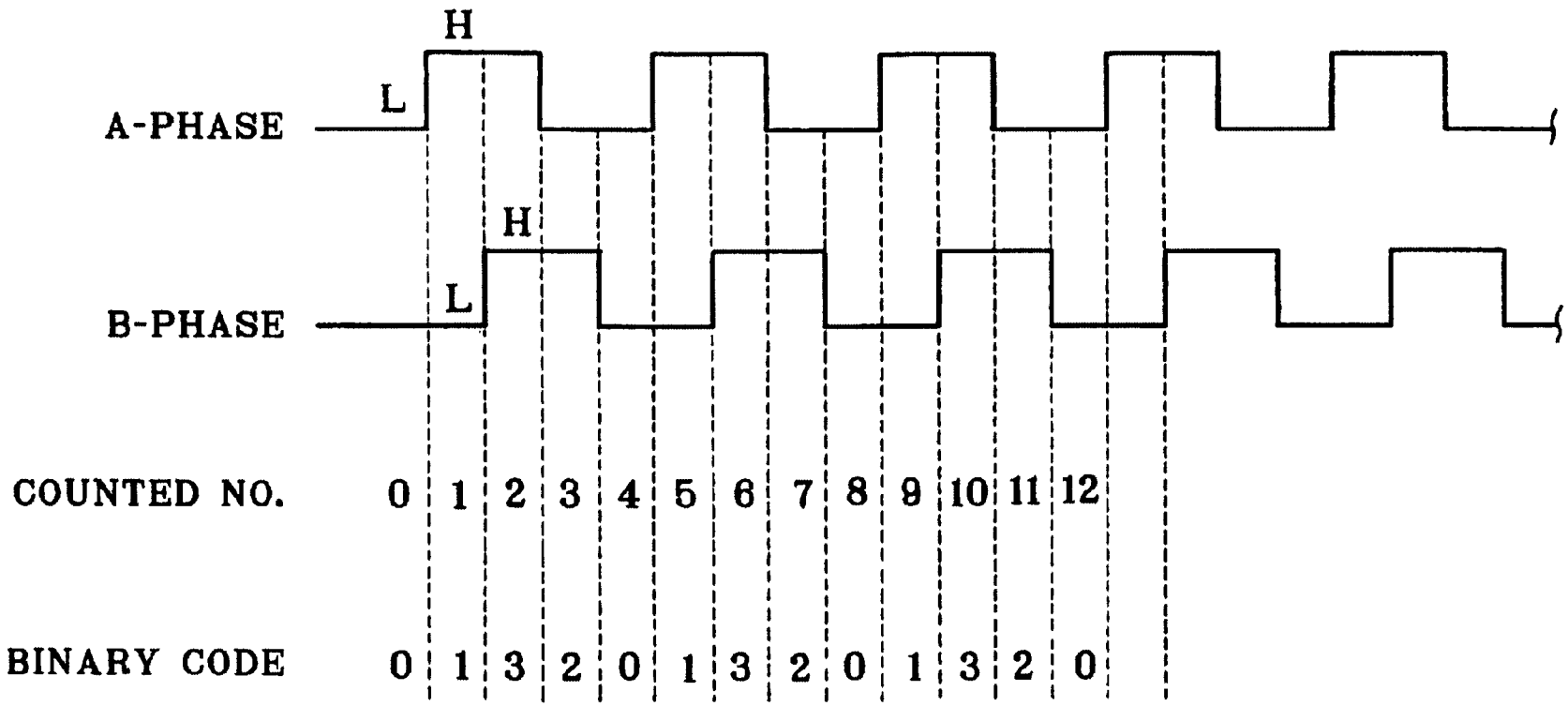
FIG. 13 is a timing chart illustrating signals of detection from an encoder.

The contact lever 49 makes a clockwise rotation for the encoder 44 to detect the detection pattern 49*h*. In FIG. 13, the encoder 44 outputs a detection signal of which there is a phase difference between the A and B-phases. If the A-phase is L, and if the B-phase is L, then a value of the binary code is 0. If the A-phase is H, and if the B-phase is L, then a value of the binary code is 1. If the A-phase is H, and if the B-phase is H, then a value of the binary code is 3. If the A-phase is L, and if the B-phase is H, then a value of the binary code is 2. Those are repeated in the order of 0, 1, 3 and 2. When the contact lever 49 makes a counterclockwise direction, the binary codes change in the order of 2, 3, 1 and 0. Monitoring of the binary code is adapted to detection of one of the directions in which the contact lever 49 rotates.

There is a counter 59 to which detection signals of the A-phase and B-phase of the encoder 44 are input. While the contact lever 49 makes a clockwise rotation, the counter 59 incrementally counts the number in response to a rise and a drop of the detection signals of the A-phase and B-phase. While the contact lever 49 makes a counterclockwise rotation, the counter 59 decrementally counts the number in response to a rise and a drop of the detection signals of the A-phase and B-phase. Accordingly, it is possible to detect a rotational position of the contact lever 49.

The microcomputer 39 calculates a rotational angle of the contact lever 49 according to its rotational position. An angle θ between the edge receiving projection 56 and the Y-axis is determined according to the calculated rotational angle of the contact lever 49. An offset amount Y1 of the recording paper 14 as viewed in the direction Y or main scan direction is determined according to a distance d and the angle θ, where the distance d is defined between a rotational center of the contact lever 49 and the edge receiving projection 56. The following expressions are equations for obtaining the offset amount Y1 of the recording paper 14 according to a rotating amount of the contact lever 49.

$$\theta=\theta 0-p\cdot n/4$$

$$Y1=d/\tan\theta$$

where θ is an angle of the edge receiving projection 56,

θ0 is a reference angle of the edge receiving projection 56 where the counted number of the encoder 44 changes from 0 to 1, p is a pitch angle of each slit, n is the counted number of the encoder 44, d is a distance between a rotational center of the contact lever 49 and the edge receiving projection 56.

The second contact lever 50 is not further described, because the second contact lever 50 is constructed only by horizontally symmetrical conversion of the contact lever 49. There is a counter 61 for cooperation with the second contact lever 50 and the encoder 45 to detect a second lateral edge of the recording paper 14. The counter 61 is not hereinafter described further.

The operation of the above-described construction is referred to now. At first, a command signal to start printing is input to the color thermal printer 2. Rotation of the motor 19 causes the recording paper roll 15 to rotate, to feed the recording paper 14 in the direction A.

While the recording paper 14 is fed, the two lateral edge portions of the recording paper 14 push and rotate the edge receiving projection 56 of the contact levers 49 and 50. Each of the encoding sensors 44*s* and 45*s* detects the detection pattern 49*h* of the contact levers 49 and 50. Detection signals are output by the encoders 44 and 45, are counted by the counters 59 and 61, which send information of the counted numbers to the microcomputer 39. The microcomputer 39 receiving the counted numbers determines rotational directions of the contact levers 49 and 50, their rotating amounts, and an offset amount of the recording paper 14 with respect to the main scan direction.

When a front edge of the recording paper 14 is detected by the front edge sensor 31, drive pulses input to the motor 19 start being counted. The counted number is obtained, to determine a moved amount of the recording paper 14. When a starting edge of a recording region of the recording paper 14 directed downstream reaches a position at the heating element array 26 of the thermal head 24, then the motor 19 is stopped.

While the recording paper 14 is stopped, the pinch roller 21 is shifted mechanically by a shifter (not shown), so the recording paper 14 is squeezed between the same and the capstan roller 20. The platen roller 25 is shifted by the shifter 29, so the recording paper 14 is nipped between the same and the heating element array 26.

The feeder roller set 18 feeds the recording paper 14 in the direction A. The microcomputer 39 controls the thermal head driver 27, and causes the same to drive the thermal head 24 according to the offset amount of the recording paper 14, to print a yellow image by one line. Accordingly, the yellow image is formed in the full-width form in the first recording region included in the recording paper 14. There occurs no wasteful heating of the heating elements 24*e*.

When the yellow recording is completed, the recording paper 14 is moved in the direction A to set a rear edge of the first recording region at the yellow fixing lamp 33. At this time, the recording paper 14 is stopped. The platen roller 25 is shifted away from the recording paper 14. Then the yellow fixing lamp 33 is turned on, to move the recording paper 14 in the direction B, to fix the yellow coloring layer.

When the fixation of the yellow coloring layer is completed, the yellow fixing lamp 33 is turned off. The recording paper 14 is fed in the direction A. Then the starting edge of the recording region comes to the position opposed to the heating element array 26, the recording paper 14 stops being fed. The platen roller 25 is shifted and pressurizes the recording paper 14, to start the magenta recording.

Also in the magenta recording, an offset amount of the recording paper 14 in the main scan direction is detected by the position detectors 41 and the microcomputer 39. Thus, no wasteful heating of the heating elements 24*e* takes place in relation to positions outside the recording paper 14. A magenta image can be recorded to the first recording region of the recording paper 14 reliably in the full-width form. Also, no error in the registration occurs between the yellow and magenta colors.

After the magenta recording is completed, the magenta coloring layer is fixed in the same manner as the yellow coloring layer. Then a cyan image is recorded next. The thermal printing for the cyan can be in consideration of the offset amount of the recording paper 14 in the main scan direction. There occurs no wasteful use of the heating element array 26, or no error in the color registration.

The recording paper 14 upon the completion of the cyan recording is moved in the direction A. The end of the recording region is cut by the cutter 37, to eject the printed portion with the recording region to the outside of the printer.

In the above embodiment, each position detector is constituted by the contact lever 49 in the plate shape and the rotatable encoding panel 49*d* formed with the contact lever 49. The rotatable encoding panel 49*d* is rotated together with the contact lever 49. However, the rotatable encoding panel 49*d* can be an element separate from the contact lever 49, and may be engaged or connected therewith. When the contact lever 49 is rotated, the rotatable encoding panel 49*d* may be responsively rotated by the engagement. In place of the rotatable encoding panel 49*d* as a detection plate, it is possible to use a slidable plate as a detection plate. Another preferred embodiment is hereinafter described, in which the slidable structure is used. Elements similar to those in the above embodiment are designated with identical reference numerals.

Figure 14:
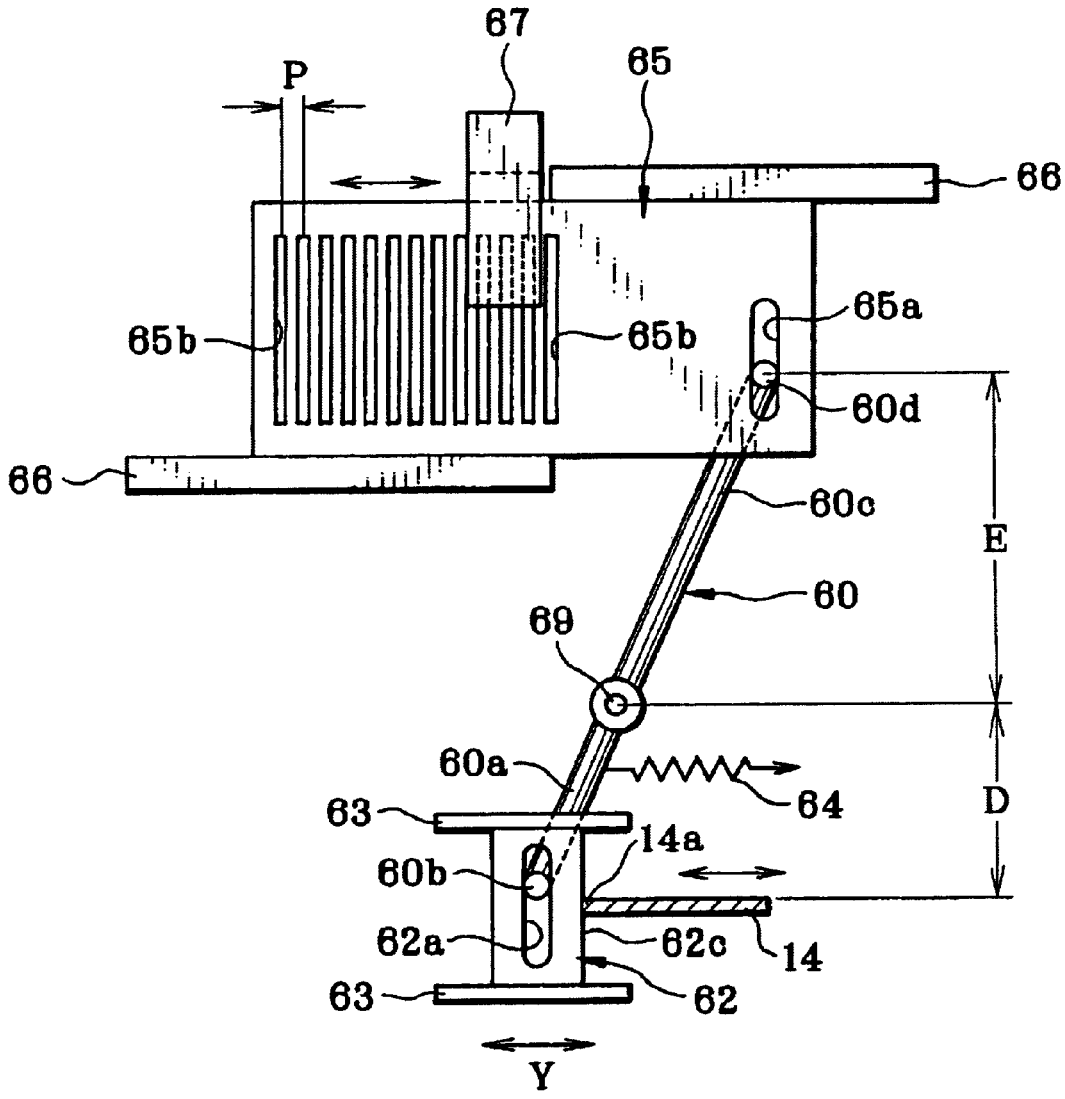
FIG. 14 is a front elevation illustrating another preferred position detector including a slidable structure.

In FIG. 14, a position detector of another preferred embodiment is illustrated. Each of two position detectors is constituted by a contact lever 60, an edge receiving block 62 as edge receiving portion, and a slidable encoding panel 65. A bearing pin or rotational central pin 69 at a middle point keeps the contact lever 60 rotationally shiftable on the inside of the thermal printer. A lower lever end 60*a* of the contact lever 60 is provided with a cam follower pin 60*b* projecting horizontally. A cam slot 62*a* is formed in the edge receiving block 62, extends vertically, and receives insertion of the cam follower pin 60*b* for engagement.

Sliding guide rails 63 as a guide mechanism are disposed beside the feeding path for the recording paper 14, and keep the edge receiving block 62 slidable in the main scan direction. Inner sides of the sliding guide rails 63 contact and receive the lateral edges of the recording paper 14. An edge contact surface 62*c* of the edge receiving block 62 receives the lateral edge of the recording paper 14. A tension coil spring 64 as a bias mechanism is connected with the lower lever end 60*a* of the contact lever 60 for biasing the contact lever 60 in the counterclockwise direction. Thus, the lateral surface of the edge receiving block 62 always contacts a lateral edge 14*a* of the recording paper 14.

An upper lever end 60*c* of the contact lever 60 is provided with a cam pin 60*d* projecting horizontally. A cam follower slot 65*a* is formed in the slidable encoding panel 65, extends vertically, and receives insertion of the cam pin 60*d*. Sliding guide rails 66 as a guide mechanism are disposed higher than the feeding path of the recording paper 14, and keep the encoding panel 65 slidable in the main scan direction. A detection pattern 65*b* of slits is formed in the slidable encoding panel 65. Each of the slits extends in the vertical direction. An encoding sensor in an encoder 67 is disposed so that the detection pattern 65*b* is located between the emitting and receiving elements of the encoding sensor.

While the 14 is not moved, the contact lever 60 is caused by the tension coil spring 64 to rotate in the counterclockwise direction. The slidable encoding panel 65 is slid to the initial position located on the left side in the drawing. Thus, a closed portion of the slidable encoding panel 65 not having the detection pattern 65*b* is opposed to the encoder 67. This is effective in stabilizing an output level of the encoder 67.

In the present embodiment, the edge receiving block 62 in contact with the lateral edge 14*a* of the recording paper 14 is slid in the main scan direction. The contact lever 60 is rotated by the slide of the edge receiving block 62, in response to which the slidable encoding panel 65 is slid. An amount of sliding of the slidable encoding panel 65 is measured by detection of the detection pattern 65*b* with the encoder 67. This is effective in measuring the position of the lateral edge 14*a* of the recording paper 14 by evaluating the counted number of the encoder 67.

The following is a set of equations for determining the offset amount of the recording paper 14 according to the counted number in the encoder 67 of the present embodiment.

$$Y=P\cdot n/4/N$$

$$N=E/D$$

where Y is the offset amount of the recording paper 14,

D is a vertical distance between the central pin 69 and the recording paper 14, E is a vertical distance between the central pin 69 and the cam pin 60*d*, N is a lever ratio of the contact lever 60, P is a pitch of the slits, n is the counted number of the encoder 67.

Note that the reference angle θ0 is required for determining the lateral edge position of the recording paper 14 in the first embodiment having the rotatable encoding panel 49*d*. However, there occurs an error in the offset amount of the recording paper 14 if an error exists in the reference angle θ0. The second equation included in the equation set for conditioning the rotatable encoding panel 49*d* is based on a trigonometric function. The value of the error is not fixed, but changes according to the value of the reference angle θ0 because of trigonometric changes. Such an error is likely to be as great as a value from several microns to several tens of microns because of insufficient precision of positioning the encoder or the contact lever 49. This error is not negligible specifically in case of 300 dpi of precision in the performance of the printer.

In contrast, the construction having the slidable encoding panel 65 is capable of detecting the position of the lateral edge 14*a* of the recording paper 14 only according to the relative slid amount of the slidable encoding panel 65. The edge receiving block 62 for contact with the lateral edge 14*a* of the recording paper 14 is slidable in the main scan direction. There occurs no change in the lever ratio of the contact lever 60 even upon a change of the height of the recording paper 14. The position of the lateral edge 14*a* can be detected with a reliably high precision.

It is to be noted that the edge receiving block 62 for contact with the lateral edge 14*a* of the recording paper 14 can be used in the first embodiment including the rotatable encoding panel 49*d*. It is possible in the second embodiment including the slidable encoding panel 65 that a lower end of the contact lever 60 directly contacts the lateral edge 14*a* of the recording paper 14 without the separate use of the edge receiving block 62.

In the detection structure of the above embodiments, a widthwise range of the recording paper 14 can be detected as an additional effect. For example, a cleaning sheet for cleaning the thermal head 24 has a greater width than the recording paper 14. In view of this, the detection structure detects one of first and second widths associated with the recording paper 14 and the cleaning sheet either of which is positioned. According to the detected one of those, the operation of advancing the sheet can be controlled as desired for one of cleaning and printing.

The rotational direction of the contact lever may be other than that according to the above embodiment. It is possible to shape and structure the contact lever as intended for the arrangement of the elements in the printer or the outer shape of the printer body.

Furthermore, a thermal printer according to the invention may be a monochromatic thermal printer, wax transfer thermal printer, sublimation thermal printer, ink-jet printer, laser printer, electrophotographic copier, or other image forming apparatuses in which recording medium is moved for forming an image.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A lateral edge position detector for a recording medium including lateral edges extending in a first direction of feeding, said lateral edge position detector comprising:

a movable lateral edge contact mechanism for being pressed by one of said lateral edges, to move away;

an encoding panel for shifting together with said lateral edge contact mechanism, said encoding panel including plural slits arranged in a shifting direction at a regular pitch;

an encoding sensor for optically detecting said slits moving past a detection region thereof, to output at least an A-phase pulse and a B-phase pulse that is deviated from said A-phase pulse by a half of said pitch;

a counter for determining a direction of being up or down according to a phase difference between said A and B-phase pulses, and for counting said A and B-phase pulses, wherein a counted number of said counter represents a position of said one lateral edge in a width direction crosswise to said first direction.

2. A lateral edge position detector as defined in claim 1, wherein said lateral edge contact mechanism is movable in said width direction.

3. A lateral edge position detector as defined in claim 2, wherein said encoding panel is movable in a region of a surface of said recording medium.

4. A lateral edge position detector as defined in claim 1, further comprising a bias mechanism for biasing said encoding panel toward an initial position.

5. A lateral edge position detector as defined in claim 4, wherein said encoding panel has a closed portion without said slits, and said closed portion is positioned in said detection region of said encoding sensor when said encoding panel is set in said initial position.

6. A lateral edge position detector as defined in claim 5, wherein said lateral edge contact mechanism includes an edge receiving portion for extending with an inclination with reference to said first direction, and for being pressed by a corner of a front end of said recording medium to move in said width direction against said bias mechanism, thereafter an end of said edge receiving portion being kept in contact with said one lateral edge.

7. A lateral edge position detector as defined in claim 6, further comprising a reinforcer overlaid on said edge receiving portion.

8. A lateral edge position detector as defined in claim 6, wherein said edge receiving portion has two block ridges for receiving respectively upper and lower surfaces of said recording medium, for regulation in a direction of said recording medium surfaces.

9. A lateral edge position detector as defined in claim 6, wherein said lateral edge contact mechanism is formed with said encoding panel, and rotatable about an axis extending in said first direction.

10. A lateral edge position detector as defined in claim 6, wherein said lateral edge contact mechanism and said encoding panel are movable respectively in said width direction, further comprising a transmission mechanism for connection of said lateral edge contact mechanism and said encoding panel.

11. A lateral edge position detector as defined in claim 10, wherein said transmission mechanism is rotational.

12. A printer including a printhead for image recording to a recording medium, comprising:

a pair of feeder rollers for moving said recording medium in a first direction, said recording medium including lateral edges extending in said first direction;

a movable lateral edge contact mechanism for being pressed by one of said lateral edges, to move away;

an encoding panel for shifting together with said lateral edge contact mechanism, said encoding panel including plural slits arranged in a shifting direction at a regular pitch;

an encoding sensor for optically detecting said slits moving past a detection region thereof, to output at least an A-phase pulse and a B-phase pulse that is deviated from said A-phase pulse by a half of said pitch;

a counter for determining a direction of being up or down according to a phase difference between said A and B-phase pulses, and for counting said A and B-phase pulses, wherein a counted number of said counter represents a position of said one lateral edge in a width direction crosswise to said first direction; and a controller for controlling said printhead according to said counted number of said counter, to suppress recording an image in a portion of said recording medium outside said one lateral edge.

13. A printer as defined in claim 12, wherein said printhead is a thermal head having plural heating elements, and said controller keeps end region heating elements turned off, said end region heating elements being included in said plural heating elements in an array, and disposed outside said one lateral edge.

14. A printer as defined in claim 13, further comprising a bias mechanism for biasing said encoding panel toward an initial position.

15. A printer as defined in claim 14, wherein said encoding panel has a closed portion without said slits, and said closed portion is positioned in said detection region of said encoding sensor when said encoding panel is set in said initial position.

16. A printer as defined in claim 15, wherein said lateral edge contact mechanism includes an edge receiving portion for extending with an inclination with reference to said first direction, and for being pressed by a corner of a front end of said recording medium to move in said width direction against said bias mechanism, thereafter an end of said edge receiving portion being kept in contact with said one lateral edge.

* * * * *